United States Patent [19]

Balinov et al.

[11] 4,025,120

[45] May 24, 1977

[54] FEED SYSTEM OF A COAL GETTING COMBINE

[76] Inventors: Igor Mikhailovich Balinov, Krasnoarmeiskaya ulitsa, 5, kv. 73; Georgy Nikiforovich Samsonov, Krasnoarmeiskaya ulitsa, 5, kv. 37; Vladimir Mikhailovich Balykov, Fakultetsky pereulok, 3, kv. 54; Vadim Ivanovich Paramonov, ulitsa Petra Romonova, 12, kv. 15; Nikolai Mikhailovich Demyashkin, Leningradsky prospekt, 9, kv. 59, all of Moscow, U.S.S.R.

[22] Filed: June 7, 1976

[21] Appl. No.: 693,555

[52] U.S. Cl. ..... 299/43; 299/34; 74/422; 74/465; 105/29 R

[51] Int. Cl.[2] ..... E21C 29/02

[58] Field of Search ..... 299/42, 34, 43–48; 74/422, 842, 464, 465; 105/29 R, 30

[56] References Cited

UNITED STATES PATENTS

| | | | |
|---|---|---|---|
| 3,079,807 | 3/1963 | Hornsteiner | 74/465 X |
| 3,753,596 | 8/1973 | Pentith | 299/43 |

FOREIGN PATENTS OR APPLICATIONS

| | | | |
|---|---|---|---|
| 1,202,051 | 9/1958 | France | 299/43 |

*Primary Examiner*—Ernest R. Purser

*Attorney, Agent, or Firm*—Lackenbach, Lilling & Siegel

[57] ABSTRACT

The feed system of a coal getting combine, which works with a face conveyor, comprises: a traction device located on the combine and having a cylinder-shaped sprocket on the side surface of which a circular spherical-shaped recess is provided, slots being made on both inner sides of the spherical recess, said slots having an involute-spherical surface. Arranged lengthwise of the conveyor is a longitudinally traversable guide bar secured at the ends of the conveyor and composed of a number of separate tubular sections articulated together and provided with open-end holes arranged square with the longitudinal axis of said holes. Engagement elements are mounted in the holes of the tubular sections allow motion pivotally around their own axis and traversably, within certain limits, lengthwise of the hole axis, said elements being adapted to interconnect said sections to the traction device and being shaped as fingers with hemispherical ends, the fingers are so positioned that their ends project beyond the holes on both sides of the sections. The circular spherical-shaped recess in the sprocket follows the tubular shape of the sections, and the sprocket itself is adapted to straddle the sections in such a manner that the finger ends should engage the sprocket slot, thus effecting the involute-spherical mangle-type gearing, whereby the fingers can be turned.

11 Claims, 13 Drawing Figures

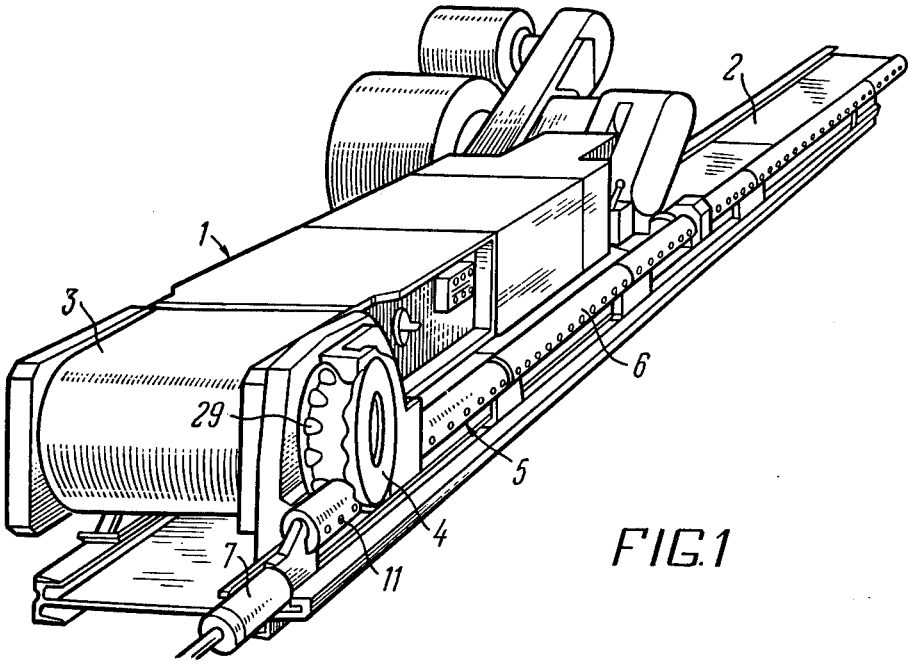
FIG. 1
FIG. 3
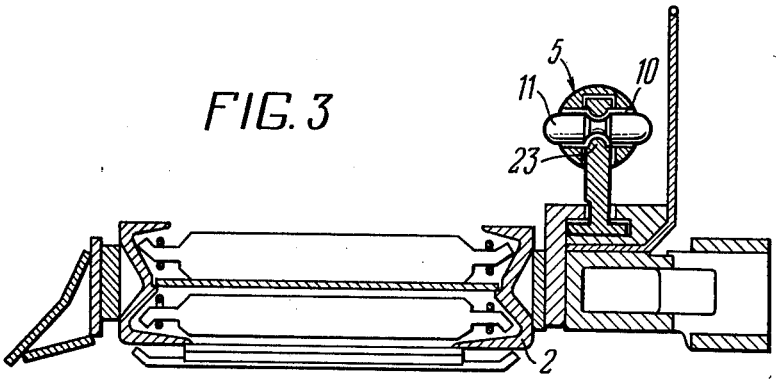
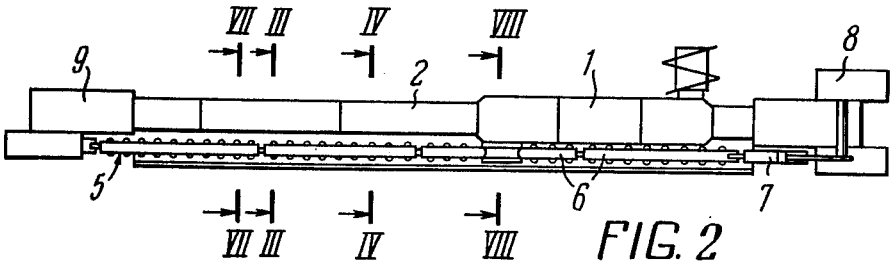
FIG. 2

FIG. 4
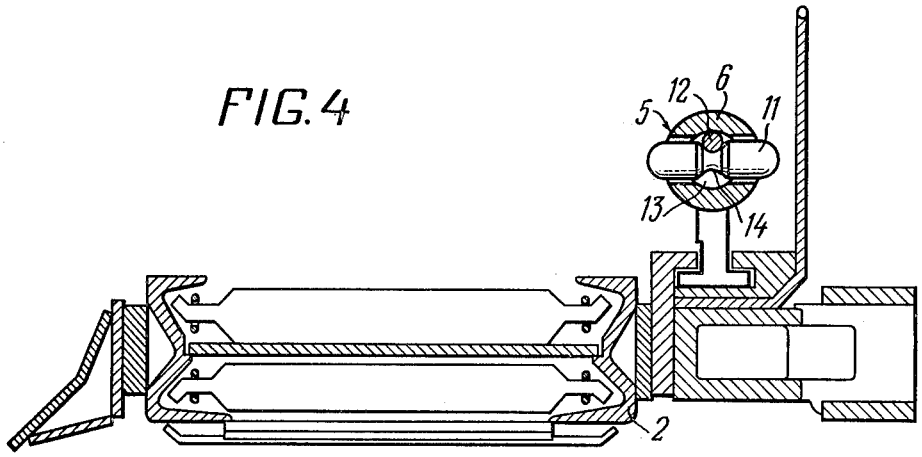
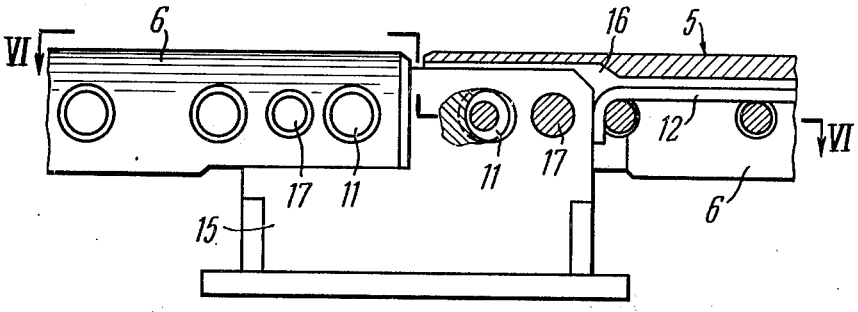
FIG. 5
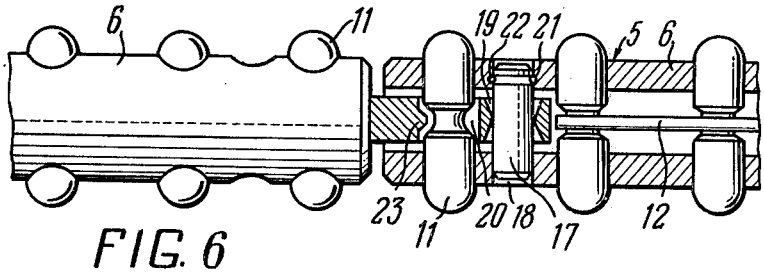
FIG. 6

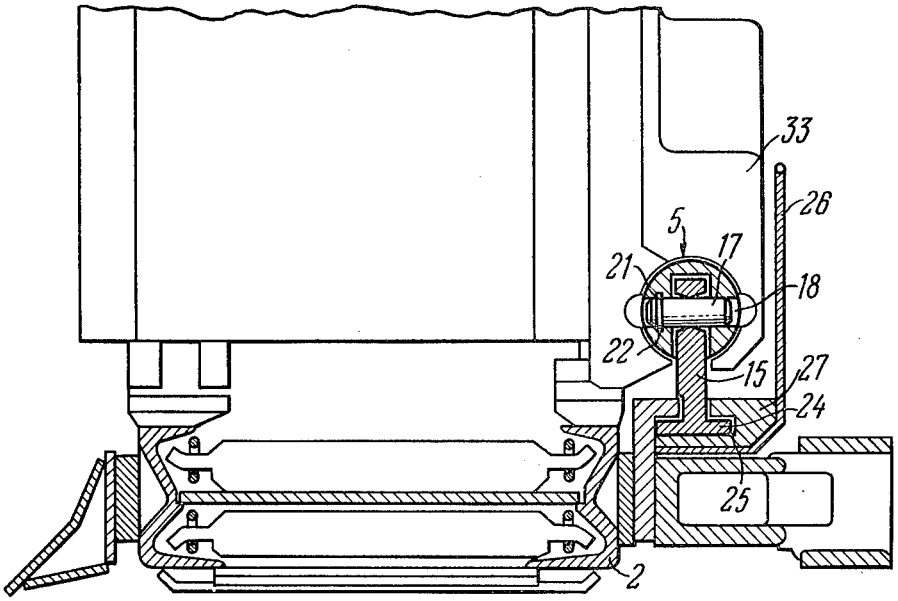
FIG. 7
FIG. 8
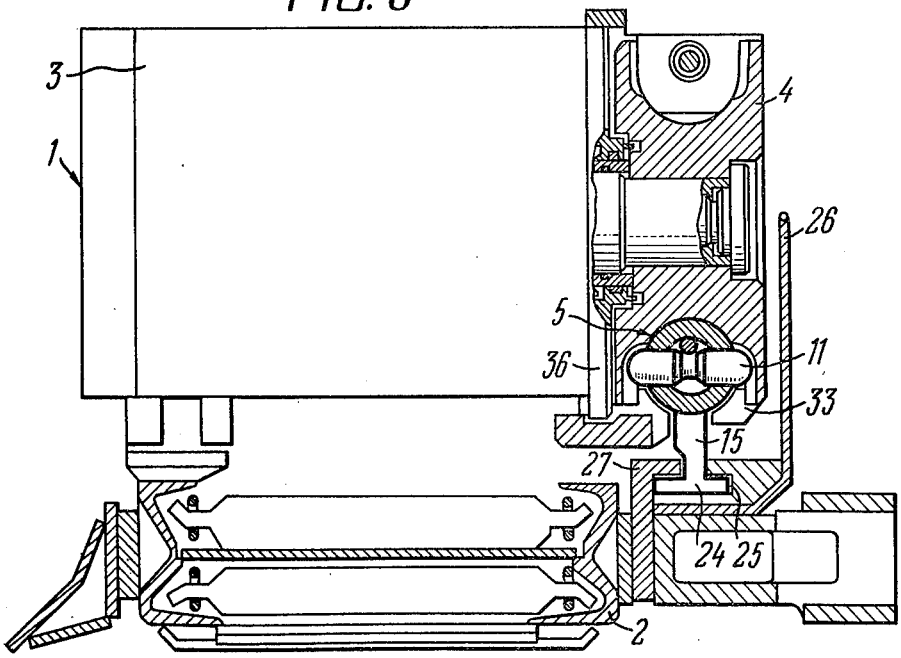

FEED SYSTEM OF A COAL GETTING COMBINE

The present invention relates generally to equipment for mechanization of coal working in collieries, and has particular reference to the feed system of coal getting combines.

The invention can be used most effectively when used for narrow coal getting combines traveling lengthwise of the coal face.

The invention can also be applicable in the feed system of drillrigs, diverse kinds of hoisting machinery, elevators, funicular railways, overhead monorail tracks in the case of steep slopes, as well as in any other system, where it is necessary to effect feed motion with considerable forces applied.

As a rule, the feed system of a coal getting combine comprises the following components:

traction equipment mounted on the combine, incorporating a hydraulic drive, reduction gear unit and pulling actuators made as hydraulic power cylinders with grippers, or tracks, or sprockets; and a guide bar or chain with engaging members fixed on the face conveyor.

Chain feed systems are now in widespread use in the coalmining industry for underground coal winning, said systems being capable of ensuring combine operation under heavy feed loads and with a high productive capacity.

However, inasmuch as chain feed systems suffer from some substanial disadvantages, which reside in short service life of the chain due to deformation of the chain links contacting with the drive sprockets, liability to frequent injuries inflicted upon the attending personnel due to the breaking of the pulling chain and exremely inadequate rate of feed of the combine onto the face resulting in disturbed cutting conditions and additional dynamic loads upon the working members and drive of the combine, which adversely affects the operating reliability and endurance of the whole equipment and, particularly, of the cutting tool.

Known in the present-day practice are some prior-art chain feed systems for advancing coal getter combines along the coal face, incorporating: traction equipment provided on the combine and having a drive sprocket fixed on the drive shaft, deflecting sprockets and round-link chain stretched-out lengthwise of the face side-by-side with the conveyor and fixed at the ends thereof. The sprockets are in constant mesh with the chain so that when the drive shaft rotates, the sprockets interact with the chain to effect feed motion of the combine along the coal face.

The known chain feed systems of coal getting combines suffer from a number of disadvantages among which the following are to be cited:

when subjected to transverse vibrations or if broken, the chain is liable to inflict injury upon the attending personnel;

the chain tends to get jammed on the drive sprockets on which account the chain has to be released rather frequently and then tensioned again, this involves much lost time in manoeuvring and reduces the productive capacity of the combine;

in the case of a curved line of face, coal is liable to be kicked off the face conveyor due to the pull chain getting into the conveyor trough; and on account of the chain getting stretched out due to the variable load, the combine is fed against the coal face inadequately, whereby additional dynamic loads are liable to arise upon the cutting member and drive of the combine, the endurance and reliability of the equipment thus being adversely affected, the coal overbroken and dust formation being thus increased.

The disadvantages mentioned above that are inherent in the chain feed systems account for the necessity of developing chainless systems for feeding coal getter combines along the face.

Some prior-art chainless feed systems for coal getting combines are known to be of the walking type, capable of advancing the combine along the face conveyor, said systems incorporating a sectional-type round guide bar, each section of the bar being fixed to the face conveyor framework; built-up friction-type grippers adapted to embrace said guide bar; hydraulic jacks rigidly linked with the grippers on one side and with the frame of the combine on the other. The built-up gripper comprises a housing and a movable element accommodated therein and adapted to be brought in contact with the guide bar either hydraulically or mechanically to grip the latter. A combine provided with such feed mechanisms travels automatically in three cyclic stages:

1. Bringing the gripper in contact with the guide bar to grip the bar by the movable element.
2. Travelling the combine along the guide bar for the length of stroke of the hydraulic jack piston, with the gripper being stationary.
3. Bringing the gripper out of contact with the guide bar and moving the gripper lengthwise of the guide bar to the initial position for a next working stroke.

The walking-type feed system of coal getting combines is disadvantageous in featuring the cyclic operation with standstills at the moment of changing-over the hydraulic jacks and grippers. The stops are accompanied by instantaneous changes in the rate of feed resulting in high additional dynamic loads detrimental to both the guide bar and the drive of the combine.

The system of self-acting grippers from low reliability and sophisticated design.

Further, the friction grippers hamper the development of high pull forces, while coal dust and fines getting onto the guide bar lower the coefficient of friction thereof, and this results in slipping of the gripper along the guide bar.

There are also known the walking-type chainless feed systems of coal getting combines, incorporating: traction equipment of the coal getting combine, having number of output shafts; grippers with spring-actuated fingers mounted on a guide bar rigidly linked with the conveyor frameworks. The grippers are joined with the output shafts of the traction equipment through a crank gear and pull rods spaced apart from one another at an angle sufficient to ensure a continuous feed in the case of consecutive operations of the grippers. The guide bar is a welded structure made as a tubular element welded to the bracket, wherein slots are provided for the spring-actuated fingers of the grippers. The brackets are held in position on the conveyor frameworks. The fingers of the grippers are controlled either mechanically or hydraulically. When the output shafts of the traction equipment rotate, the pull rods interconnected with the crank gear cause the grippers to travel along the guide bar. The gripper fingers engage the slots in the guide bar under the action of their springs; on further movement of the pull rods one end of the grippers causes the combine to travel with respect to the stationary fixed guide bar. Thus, the grippers operate consecutively and cyclically in the following way:

1. Fixing the gripper on the guide bar upon engagement of the slots by the fingers;
2. Travelling the combine along the stationary guide bar;
3. Releasing the gripper upon disengagement of the fingers from the slots by virtue of hydraulic or mechanical devices, and travelling the released gripper along the guide bar.

The disadvantage inherent in said feed system resides in its being cumbersome and sophisticated. The system of self-acting grippers is complicated and inefficient such grippers are suitable only for high feed loads. In addition, the operating routine, that calls forth considerable dynamic loads when the gripper fingers are thrown into engagement, restricts the endurance of the whole system and affects the operating reliability. Moreover, such grippers are hardly amenable to cleaning out the coal fines getting into the slots thereof.

There are also known to be in current use the track-type continuous feed systems of coal getting combines, comprising: traction equipment of the combine featuring a driving and a tension sprocket held to the combine frame; an endless track chain mounted on sprockets; and a guide bar rigidly coupled to the conveyor frames. The combine travels at the expense of engagement of the endless track chain with the guide bar. Further, the track chain links can be provided with lugs; be this the case, the guide bar has slots for the lugs to engage. According to another design version, the chain may be made of plates with slots provided therebetween; in this case the guide bar is in fact a toothed rack. Rotation of the driving sprocket causes the chain to move and to impart motion to the combine by virtue of the engagement of the chain with the guide bar.

Track-chain feed systems, however, are featured by inadequately smooth feed and low adaptability to curves of the face conveyor and changes of the hypsometric particulars of the coal seam. The track chain getting stretched out in the course of service life results in disturbed engagement, so that provision should be made for chain tension devices to compensate for chain elongation.

This, however, makes the construction of the whole system unwieldly. Moreover, the engagement of the tracks with the guide bar is badly affected due to soiling or clogging of the latter with coal dust and fines. Thus, some auxiliary devices are necessary for cleaning the guide bar.

In addition, when the track lugs are thrown in or out of engagement with the guide bar, the rate of feed is badly varied which results in joggles or impacts.

Another system of the track-type feed system of a coal getting combine is now used currently, incorporating traction equipment of the combine with a driving sprocket and a number of tension sprockets secured on the combine frame; an endless roller chain mounted on the sprockets; and sectional-type guide bar with fingers. Each of the sections of the guide bar is rigidly held to the conveyor framework and is articulately linked to the neighbouring section. The fingers are loosely mounted in the guide bar sockets in such a manner that those of the fingers which are not involved in engagement are sunk in their sockets either by their own weight or by virtue of an appropriate auxiliary device so as not to interfere with the free passing of the combine frame.

A wedgelike slide block is provided on the combine frame under the pull chain and his adapted to bring the latter in engagement with the guide bar fingers.

Advancement of the combine lengthwise of the coal face is effected from the driving sprocket and roller chain which is engageable with the guide bar fingers. While resting upon the fingers, the chain propels the combine along with the slide block in such a way that the latter passes under the guide bar and chain and raises the fingers, with the result that the chain is in constant engagement and the combine is fed continuously. The fact that when inoperative the fingers are sunk in the guide bar sockets contributes to cleaning of the guide bar surface from coal fines.

The disadvantages inherent in the system reside in an inadequately smooth feed and low adaptability to curvatures of the face conveyer and changes in the hypsometric particulars of the coal seam being worked. Further, the track chain is liable to stretch out during the service life which disturbs its engagement and involves special mechanism for chain tensioning to compensate for its elongation; thus, the construction of the system is made bulky. Furthermore, forasmuch as the section of the guide bar are fixed on the conveyer frameworks, the guide bar articulated joints are additionally loaded by the forces developed in the conveyor in the course of its relocation. This necessitates additional joining elements so as to provide reliable operation of the system. In addition, the fingers thrown in engagement are overhung from the guide bar and thus work in flexure at a long arm of the bending force applied (i.e., high cantilever bending moment) which might result in broken fingers and adversely affects the operating reliability of the combine.

It is also known to use a continuous feed system of the friction type, comprising: flat guides shaped as a rail, I-beam, etc., rigidly fixed on the face conveyer frameworks; driving wheels secured on the combine frame; and a drive for rotating said wheel provided on the combine frame.

The driving wheels are arranged on both sides of the guide and are forced thereagainst by means of arms controlled either hydraulically or mechanically. The wheels are faced with a material possessing a high coefficient of friction; while rolling over the stationary guide, the wheels impart motion to the combine due to the forces of friction. The merit of the frictional engagement resides in its good adaptability to the various obliquities or curvatures of the system. However, this involves gapless joints and long-sweep curves of the guide.

In addition, frictional engagement is practicable only in the case of low feed loads.

The afore-discussed system suffers from the disadvantage that under conditions of coal faces heavily laden with coal dust one fails to attain stable values of the coefficient of friction of the wheel rolling over the guide, which hampers the development of high pulling forces.

Another chainless feed system of coal getting combines is known to be used heretofore, incorporating traction equipment with a driving gear wheel located on the combine and a toothed guide bar arranged lengthwise of the conveyer and traversably therealong.

The guide bar is provided as a toothed rack composed of separate sections articulated to one another.

The sectional toothed rack is rigidly fixed with its ends to the drive and to the end heads of the conveyer and is loosely positioned in the conveyer trough, whereby its longitudinal traversing is ensured.

The trough side boards keep the rack from falling out.

Among the disadvantages inherent in said system the following are to be cited: high deflecting forces resulting from engagement of the gear wheel with the toothed rack which involves the use of powerful grippers and leads to a low efficiency of the system and, consequently, to its higher overall size which hampers the application of the combines having such a feed system.

The engagement of the gear wheel with the toothed rack is badly affected by coal dust and fines stuck to the latter.

Moreover, any cast components of the rack cannot be used due to high feed loads, while the manufacture of a toothed rack of an adequate accuracy by means of mechanical treatment is a complicated, laborious and technologically inefficient operation.

It is therefore a primary object of the present invention to eliminate the disadvantages now inherent in chainless feed systems.

It is another object of the present invention to provide a reliable and safe feed system for coal getting combines.

It is one more object of the present invention to provide a feed system of coal getting combines capable of smooth feeding of the combine along the coal face and of higher utilization efficiency of the combine propelling motor.

It is a further object of the present invention to increase the stability of coal getting combines.

It is still another object of the present invention to reduce dynamic loads upon and increase the operating reliability of coal getting combines.

It is yet still another object of the present invention to provide fast mounting and dismantling of the feed system of a coal getting combine in longwall faces, as well as to render the system easily maintainable.

It is likewise an object of the present invention to obviate an additional load exerted upon the conveyer by the feed forces that tend to overturn the conveyer sections.

It is an additional object of the present invention to provide for easy cleaning out from the guide bar of the coal fines and rock debris.

It is also an object of the present invention to increase the productive capacity of the coal getting combine and to make its operation safer due to some improvements in the construction of the feed system thereof.

Said objects are accomplished by a feed system of a coal getting combine mounted on the face conveyer, incorporating a traction device located on the combine, and a guide bar made of separate sections articulated together and provided with special elements for engaging with the traction device, said guide bar being arranged lengthwise of the conveyer and traversably therealong and being fixed at the ends thereof, according to the invention, each of the guide bar sections being tubular-shaped and being provided with open-end holes arranged square with the guide bar longitudinal axis, the engaging elements of said section being made as hemispherical-end fingers and being mounted in the holes of the guide-bar sections to move pivotally around their own axis and traversably, within certain limits, lengthwise of the hole axis in such a manner that their ends project from the holes on both sides of the section, the traction device being provided with a cylindrical sprocket on the side surface of which a circular spherical-shaped recess is made to suit the shape of the tubular guide bar sections, provision being made on both inner sides of said spherical recess for slots having an involute-spherical surface, said sprocket being adapted to straddle the guide bar section in such a way that the finger ends should engage the slots in the sprocket, thus carrying out the involute-spherical type mangle gearing which imparts turning motion to the fingers.

It is desirable that a cannelure be made in the central portion of each finger and that each guide bar section be provided with retainers made as end long rods equal in length to the section and passing through the cannelures in the fingers so as to restrict the movement of the latter lengthwise of their own axis.

It is expedient that the guide bar be provided with supports located at the section-to-section joints so that the guide bar could rest through said supports upon the conveyer side board which limits the movement of the guide bar both vertically and transversely.

It is likewise advisable that pivotal grippers be provided on the combine both before and after the sprocket (as viewed along the combine run), the contour of the grippers following that of the guide bar, said grippers being adapted to straddle and rest upon the tubular guide bar, thus ensuring constant engagement of the sprocket with the guide bar and its cleaning from coal fines.

It is also reasonable that the guide bar arranged lengthwise of the conveyer be fixed at the ends thereof by means of tension devices aimed at restricting the amount of tension of the guide bar and at reducing dynamic loads imposed on the latter.

The tubular shape of the guide bar equipped with the engaging elements provides for good directing of the combine along the coal face, perfect engagement, high efficiency and low sensitivity to obliquities and curves of the feed system, whereby smooth feeding of the combine is attained and the utilization factor of the combine propelling motor is increased by 15 to 20 percent.

Semiround ends of the fingers provide for good contact with the sprocket and self-cleaning from coal fines.

Restriction of the axial movement of the fingers, by means of cannelures and retainers made as lengthwise arranged rods, ensures quick replacement of the fingers and their good maintainability.

Interconnection of the guide bar sections through supports obviates overtensioning of the guide bar in the course of the conveyer relocation and makes possible articulated joints between the guide bar sections.

The provision of swivel grippers ensures a high degree of cleaning out from the engaging elements and guide bar of the coal fines and rock debris and stability of the combine on the face conveyer.

Provision of the involute-spherical type mangle gearing rules out the development of any deflecting forces in the traction device and ensures high efficiency of the feed system, as well as good reliability of its operation.

Tension devices provided at the guide bar ends limit the amount of its tensioning and reduce dynamic loads exerted thereupon.

In what follows the present invention will become more apparent from a detailed disclosure of a specific embodiment thereof with reference to the accompanying drawings, wherein:

FIG. 1 is the general perspective view of a coal getting combine with the feed system proposed in the present invention;

FIG. 2 is a top plan view of the feed system of a coal getting combine;

FIG. 3 is a transverse cross-sectional view taken along the line III—III in FIG. 2 through a face conveyer and guide bar at the section-to-section joint;

FIG. 4 is a cross-sectional view through the face conveyer with the guide bar, as taken along the line IV—IV in FIG. 2;

FIG. 5 illustrates the joining of the guide bar sections with the support;

FIG. 6 is a view, partially in section, taken along the line VI—VI in FIG. 5;

FIG. 7 is a cross-sectional view through the face conveyer with the guide bar taken along the line VII—VII in FIG. 2 substantially at the section-to-section joint;

FIG. 8 is a cross-sectional view taken along the line VIII—VIII in FIG. 2;

Figure 9:
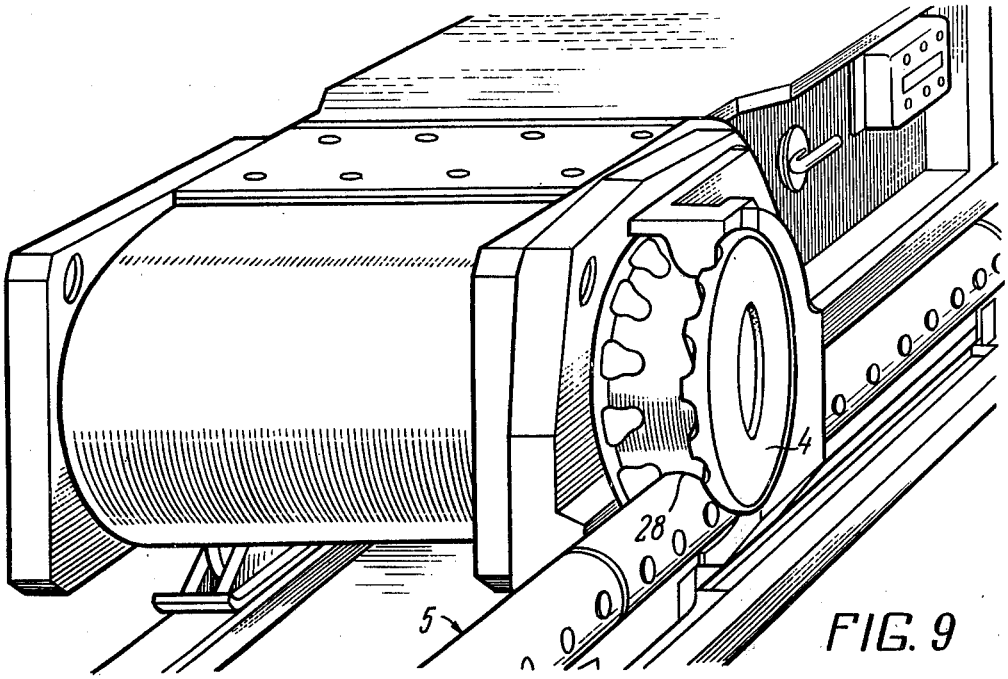
FIG. 9 is a general perspective view of a traction device of the coal getting combine.

According to the present invention, the feed system of a coal getting combine 1 (FIG. 1), mounted on a face conveyer 2 traversably therealong, incorportes: a traction device 3, with a sprocket 4 set on the output shaft of the reduction geat unit (not shown) of the traction device 3 of the combine 1, and a guide bar 5 composed of a number of separate sections 6 articulated together. The guide bar 5 is arranged lengthwise of the face conveyer 2, its end sections being held to tension devices 7 provided on a drive head 8 and an end head 9 (FIG. 2) of the conveyer 2. The tension device 7 made as, for example, a hydraulic cylinder serves for longitudinl traversing of the guide bar 5. The sections 6 of the guide bar 5 are tubular in shape and have open-end holes 10 (FIG. 3) the axes of which are at right angles to the longitudinal axis of the guide bar 5.

The engaging elements of the guide bar 5 are made as fingers 11 having hemispherical ends. The fingers 11 are loosely fitted in the holes 10 of the guide bar 5 in such a manner that their ends project from the holes 10 on both sides of the tubular guide bar 5. The diameter of the holes 10 somewhat exceeds that of the fingers 11 with a view to their pivoting freely around their own axis. To provide for a limited travelling of the fingers 11 along the axis of the hole 10 and to prevent the fingers 11 from falling out from the holes 10, retainers 12 (FIG. 4) are envisaged, adapted to be fitted into an inner space 13 of the section 6 of the guide bar 5 and accommodated in a cannelure 14 which is made in the central portion of the fingers 11. The retainer 12 may be made as a single solid rod having a contour similar to that of the cannelure 14 in the finger 11, or as a number of rods fitted into the inner space 13 of the section 6 of the guide bar 5 from both sides of said section, and also from above and below of the fingers 11.

Each two neighbouring sections 6 are joined together by supports 15 (FIGS. 5, 6) fitted into slots 16 provided at the ends of each section 6 of the guide bar 5.

The supports 15 are interconnected to the sections 6 of the guide bar 5 by coupling pins 17 (FIG. 6) and the fingers 11. Open-end holes 18 are provided in the guide bar 5, holes 19 are provided in the support 15 in which the coupling pins 17 will fit and shaped holes 20 are made in the support 15 at the joint of the two adjacent sections 6 and the open-end holes 10 (FIG. 3) for the fingers 11 to engage.

When assembling the guide bar 5 (FIGS. 5, 6) with the supports 15, the axes of the holes 18 (FIG. 6) are brought in alignment with the axes of the holes 19, and the axes of the holes 20, are brought in alignment with the axes of the holes 10 (not shown in FIGS. 5, 6).

The coupling pins 17 (FIGS 6, 7) are held in the holes 18 by snap rings 21 fitted into borings 22 made in the holes 18. The fingers 11 (FIGS. 5, 6) are retained in the shaped holes 20 by a projection 23 (FIGS. 3, 6).

The assembling procedure of the sections 6 (FIGS. 5, 6) of the guide bar 5 with the support 15 occurs as follows: the support 15 is fitted into the slot 16 of the guide bar 5 and is so displaced that the projection 23 should not interfere with the engagement of the finger 11 and the hole 10; the finger 11 is fitted into the aligned holes 10 and 20 of the guide bar 5 and the support 15, respectively. Then the supports 15 are so shifted with respect to the section 6 of the guide bar 5 that the holes 18 and 19 should align, whereupon the coupling pin 17 is set in position and locked with the snap ring 21.

To provide the joints of the sections 6 of the guide bar 5 articulated, the holes 19 (FIG. 6) in the support 15 are taper-shaped to flare outwards on both sides. The supports 15 are shaped as, for example an inverted T so that a wider horizontal portion 24 (FIG. 7) serves as a base for the support 15. The supports 15 are loosely fitted in a slot 25 (FIGS. 7, 8) of a side board 26 rigidly coupled to the conveyer 2. As to its contour the slot 25 corresponds to the support 15. Flanges 27 of the side board 26 keep the support 15 together with the guide bar 5 from being raised over the conveyer 2 and from transversal displacement, whereas longitudinal traversability of the guide bar 5 with resepct to the conveyer 2 prevents the development of additional forces that are liable to arise in the course of advancing the conveyer 2 onto the coal face, and provides for convenient mounting and dismantling.

Figure 10:
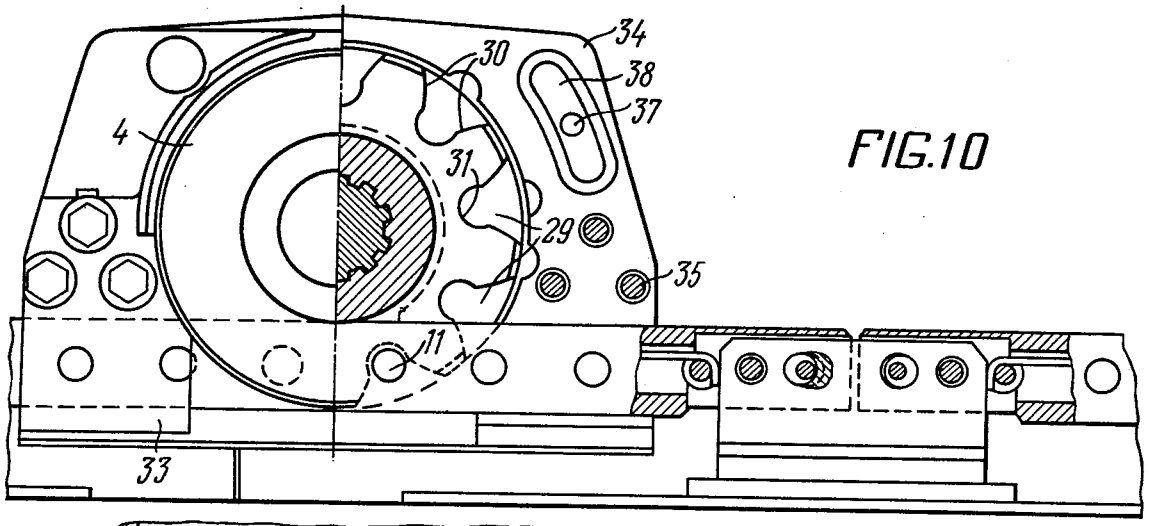
FIG. 10 is a view facing the arrow A in FIG. 8 to show the mutual arrangement of the grippers and the sprocket when the latter is engaged with the guide bar.
Figure 11:
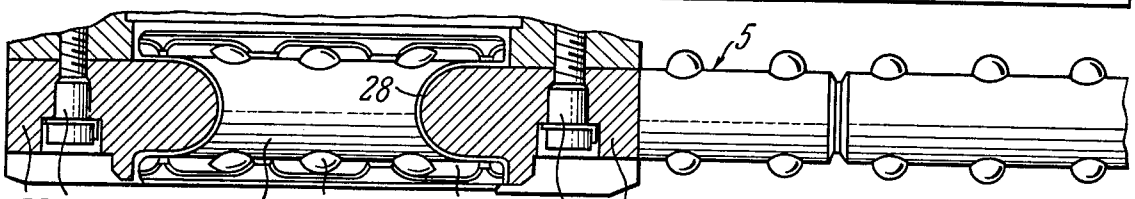
FIG. 11 is a plan view showing the mutual arrangement of the grippers and the sprocket when the latter is engaged with the guide-bar.
Figure 12:
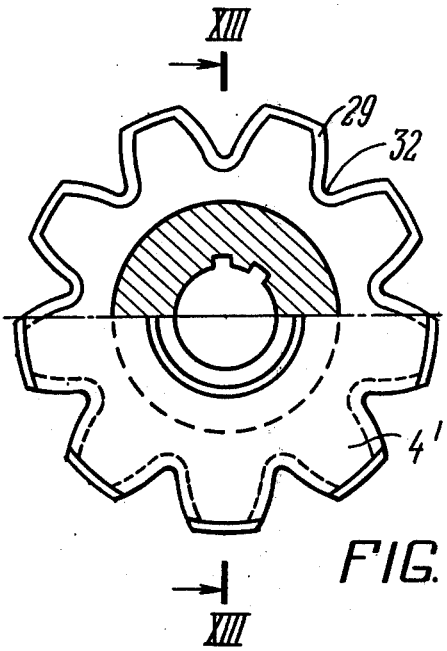
FIG. 12 is an embodiment of the sprocket.
Figure 13:
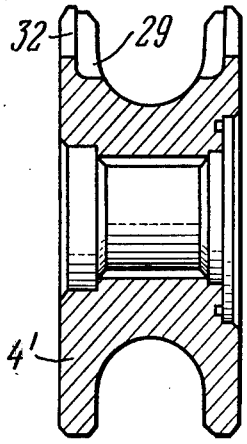
FIG. 13 is a cross-sectional view taken along the XIII—XIII in FIG. 12.

The driving sprocket 4 is cylinder-shaped (FIGS. 9, 10, 11). The side surface of the sprocket 4 has a circular spherical-shaped recess 28 to suit the shape of the tubular guide bar 5. Provided on both inner sides of the spherical recess 28 are slots 29 having an involute-spherical surface formed by involute portions 30 and spherical portions 31. FIGS. 12 and 13 illustrate an embodiment of the sprocket according to which a sprocket 4′ has through slots 32 corresponding to the slots 29 with an involute-spherical surface as presented in the FIGURES.

Such an embodiment of the sprocket 4′ is conductive to better cleaning of the slots 32 from coal fines stuck thereto in the course of operation. However, such a construction affects the centering of the fingers 11 and proves to be less safe for the attending personnel.

To provide constant and reliable meshing of the sprocket with the guide bar 5 grippers 33 are envisaged (FIGS. 10, 11) and are rigidly fixed on a plate 34 by bolts 35. The plate 34 carrying the grippers 33 is mounted to a flange 36 (FIG. 8) of the traction device 3 of the combine 1 so as to be free to swivel with respect to said flange. To restrict the swivel angle of the plate 34 (FIG. 10) and lock it in position on the flange 36 (not shown in FIG. 10), the latter is provided with a bolt 37 adapted to engage a longitudinal slot 38 made in the plate 34. The grippers 33 (FIGS. 7, 8, 11) have a contour corresponding to that of the guide bar 5 and straddle it, thus preventing the sprocket 4 from disengaging the guide bar 5. With the plate 34 (FIGS. 10, 11) carrying the grippers 33 fit in position on the flange 36 of the feed mechanism, the grippers 33 are disposed ahead of and behind the sprocket 4 closely thereto. Such a construction of the gripper 33 and its being freely pivotable on the flange 36 make it possible to adapt to any change in the position of the guide bar 5. When the sprocket 4 rolls over the guide bar 5 the foremost gripper 33 (as viewed along the direction of run of the combine) cleans the guide bar 5 from coal fines, thereby adding to good engagement.

The feed system of the combine 1 operates as follows.

When the motor of the combine 1 (FIG. 1) is switched on, the reduction gear unit of the traction device 3 imparts rotation to the sprocket 4 which is in constant mesh with the guide bar 5, and thus causes the ends of the fingers 11 (FIGS. 10, 11) to engage the slots 29 in the sprocket 4, thus effecting the involute-spherical mangle-type gearing, wherein the sprocket 4 rolls over the guide bar 5. This results in a smooth, jogless continuous advancing of the combine 1 along the guide bar 5 which takes up the pulling force of feed. Such a smooth feed of the combine 1 rules out the onset of any additional dynamic loads exerted upon the operative unit and drive of the combine 1 and adds to the durability and reliability of the whole equipment.

While rolling over the guide bar 5, the sprocket 4 causes the fingers 11 to turn through an angle in the hole 10. Such a turn of the fingers 11 prevents wearout of the engaging elements that occurs at the moment of interaction of the sprocket 4 with the fingers 11 of the guide bar 5. In addition, engagement is effected by a number of the fingers 11 entering the involute-spherical slots 29 of the sprocket 4 at a time in such a way that both ends of each finger 11 get engaged which is conducine to a uniform spread of the feed load.

Articulated joining of the sections 6 (FIG. 2) of the guide bar 5 arranged lengthwise of the conveyer 2 allows the guide bar to follow any curvature or obliquity of the conveyer 2 when the latter is advanced towards the working face, as well as to adapt to any change in the hypsometric particulars of the coal seam being worked. Inasmuch as the guide bar 5 has no rigid linkage with the framworks of the conveyer 2 but is free to traverse therealong, any possiblity of some additional forces that are liable to arise in the course of advancing the conveyer 2 onto the coal face is precluded.

When the conveyer 2 is relocated its length varies which is causative of an overtensioning of the guide bar 5. This being the case, the amount of tension of the guide bar is self-adjusted by the tension device 7 which is made possible due to the guide bar 5 being longitudinally traversable.

The construction of the herein-proposed feed system, and that of each of the components thereof, is such as to allow it to be applied in coal getting combines operating on the shuttle principle, i.e., in any direction along the coal face.

A chainless feed system enables the combine to operate without any chains or safety rope, thus avoiding injuries to the attending personnel that are liable to be inflicted upon him by the chain or rope, as well as by the coal kicking off the face conveyer.

Further, the feed system of the present invention is distinguished for the following advantageous features:

it ensures smooth feeding of the coal getting combine onto the coal face, as well as its stability on the conveyer, and reliable and trouble-free operation;

the conveyer heads and trough are relieved from the force of feed, the conveyer does not creep, and no need thus arises for any special devices for dismantling the drive and end conveyer heads;

due to the smooth advancement of the combine onto the coal face the utilization factor of the combine propelling motor is increased by 15 to 25 percent;

the fingers are capable of pivoting freely in the guide bar sections and are replaceable without dismantling the conveyer; the engagement of the guide bar with the drive sprocket is adaptable to any obliquities of the combine; the feed force is directed along the axis of the tubular guide bar, thus not causing the conveyer to overturn round the joints thereof;

the guide bar sections are joined together throughout the length of the coal face, the guide bar features a constant engagement pitch and has a movable joining with the conveyer, as well as double safeguarding of all the joints;

the application of the present feed system provides for a favourable psychologic situation for the people working in the longwall face and enables a number of production processes to be carried out along with the coal getting which adds to the labor efficiency;

the feed system proposed herein establishes the prerequisites for a safe and highly productive application of mechanized coal cutting and loading complexes involving two-combine coal getting process; and the use of the feed system of the invention adds to the grade of the coal being mined.

What is claimed is:

1. A feed system of a coal getting combine, mounted on a face conveyer, comprising: a traction device located on said combine; a cylinder-shaped sprocket, a side surface of said sprocket having a circular spherical-shaped recess, provision being made on both inner sides of said spherical recess for slots having an involute-spherical surface, said sprocket being located on said traction device; a guide bar arranged lengthwise of said conveyer and traversably therealong and fixed at the ends of said conveyer, said guide bar being composed of a number of separate tubular sections articulated together, said sections being provided with open-end holes arranged at right angles to the axes of said sections; and engagement elements adapted to connect said sections to said traction device and shaped as fingers with hemispherical ends, said elements being fitted in said holes of said tubular sections to allow motion pivotally around their own axis and traversably, within certain limits, lengthwise of the axes of said holes in such a way that their ends project from said holes on both sides of said sections; said circular spherical-shaped recess of said sprocket having the tubular shape of said sections, while said sprocket itself is adapted to straddle said sections so that the ends of said fingers engage said slots in said sprocket, thus effecting the involute-spherical mangle-type gearing, whereby turning of the fingers occurs.

2. A feed system of a coal getting combine as claimed in claim 1, wherein a cannelure is made in a central portion of each of said fingers, and each section of the guide bar is provided with retainers made as longitudinally arranged rods equal in length to said guide bar section and passing through said cannelures of said fingers so as to restrict the movement of said fingers lengthwise of their own axis.

3. A feed system of a coal getting combine as claimed in claim 1, wherein the guide bar is provided with supports located at section-to-section joints and adapted for said guide bar to rest upon a conveyer side board with a possibility of lengthwise traverse along said conveyer, said side board of the conveyer to limit the movement of said guide bar both vertically and transversely.

4. A feed system of a coal getting combine as claimed in claim 1, wherein grippers are pivotally mounted on said combine both before and after said sprocket (as viewed along the direction of run of the combine), said grippers being identical in profile with said guide bar and being adapted to straddle and rest upon said guide bar, thus ensuring constant engagement of said sprocket with said guide bar and cleaning of the guide bar from coal fines.

5. A feed system of a coal getting combine as claimed in claim 1, wherein said guide bar is fixed in position at the ends of said conveyer by tension devices which limit the amount of tension of said guide bar and reduce the dynamic loads exerted thereupon.

6. A feed system of a coal getting combine as claimed in claim 2, wherein the guide bar is provided with supports located at section-to-section joints and adapted for said guide bar to rest upon a conveyer side board with a possibility of lengthwise traverse along said conveyer said side board of the conveyer to limit the movement of said guide bar both vertically and transversely.

7. A feed system of a coal getting combine as claimed in claim 2, wherein grippers are pivotally mounted on said combine both before and after said sprocket (as viewed along the direction of run of the combine), said grippers being identical in profile with said guide bar and being adapted to straddle and rest upon said guide bar, thus ensuring constant engagement of said sprocket with said guide bar and cleaning of the guide bar from coal fines.

8. A feed system of a coal getting combine as claimed in claim 2, wherein said guide bar is fixed in position at the ends of said conveyer by tension devices which limit the amount of tension of said guide bar and reduce the dynamic loads exerted thereupon.

9. A feed system of a coal getting combine as claimed in claim 3, wherein grippers are pivotally mounted on said combine both before and after said sprocket (as viewed along the direction of run of the combine), said grippers being identical in profile with said guide bar and being adapted to straddle and rest upon said guide bar, thus ensuring constant engagement of said sprocket with said guide bar and cleaning of the guide bar from coal fines.

10. A feed system of a coal getting combine as claimed in claim 3, wherein said guide bar is fixed in position at the end of said conveyer by tension devices which limit the amount of tension of said guide bar and reduce the dynamic loads exerted thereupon.

11. A feed system of a coal getting combine as claimed in claim 4, wherein said guide bar is fixed in position at the end of said conveyer by tension devices which limit the amount of tension of said guide bar and reduce the dynamic loads exerted thereupon.

* * * * *